US009666126B2

(12) United States Patent
Jeong et al.

(10) Patent No.: US 9,666,126 B2
(45) Date of Patent: May 30, 2017

(54) DISPLAY APPARATUS AND DISPLAY METHOD

(71) Applicant: Samsung Display Co., Ltd., Yongin (KR)

(72) Inventors: Jiwoong Jeong, Yongin (KR); Gana Kim, Yongin (KR); Gyeongub Moon, Yongin (KR); Sangho Park, Yongin (KR); Jaewon Jeong, Yongin (KR); Kyunguk Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 90 days.

(21) Appl. No.: 14/598,041

(22) Filed: Jan. 15, 2015

(65) Prior Publication Data

US 2016/0042687 A1 Feb. 11, 2016

(30) Foreign Application Priority Data

Aug. 11, 2014 (KR) ..... 10-2014-0103629

(51) Int. Cl.
*G09G 3/32* (2016.01)
*G09G 3/3233* (2016.01)

(52) U.S. Cl.
CPC ... *G09G 3/3233* (2013.01); *G09G 2320/0276* (2013.01); *G09G 2320/0626* (2013.01);
(Continued)

(58) Field of Classification Search
CPC ... G09G 2320/0276; G09G 2320/0673; G09G 2320/0626
See application file for complete search history.

(56) References Cited

U.S. PATENT DOCUMENTS

2006/0238480 A1* 10/2006 Furihata ..... G09G 3/2007 345/98
2006/0284806 A1* 12/2006 Maki ..... G09G 3/3688 345/89

(Continued)

FOREIGN PATENT DOCUMENTS

KR 10-2011-0032245 3/2011
KR 10-2011-0123983 11/2011

(Continued)

*Primary Examiner* — Andrew Sasinowski
*Assistant Examiner* — Chun-Nan Lin
(74) *Attorney, Agent, or Firm* — H.C. Park & Associates, PLC

(57) ABSTRACT

A display apparatus includes a power generation unit, a control unit, a source driver, and a display panel. The control unit configured to receive image data, determine a reference grayscale value of the image data, and convert the image data to corrected data according to the reference grayscale value. The power generation unit configured to generate a first pixel driving voltage, a second pixel driving voltage corresponding to the reference grayscale value, and an analog driving voltage corresponding to the reference grayscale value. The source driver configured to generate grayscale voltages by using the analog driving voltage and output, as an image signal, a grayscale voltage corresponding to the corrected data from among the grayscale voltages. The display panel configured to receive the image signal and display an image corresponding to the image signal using the first pixel driving voltage and the second pixel driving voltage.

12 Claims, 10 Drawing Sheets

(52) U.S. Cl.
CPC ..... *G09G 2320/0673* (2013.01); *G09G 2320/103* (2013.01); *G09G 2330/021* (2013.01); *G09G 2330/028* (2013.01); *G09G 2360/16* (2013.01)

(56) References Cited

U.S. PATENT DOCUMENTS

| | | | | |
|---|---|---|---|---|
| 2011/0069098 | A1* | 3/2011 | Lee ..... | G09G 3/3225 345/691 |
| 2011/0115832 | A1* | 5/2011 | Lee ..... | G09G 3/3233 345/690 |
| 2011/0273109 | A1 | 11/2011 | Park | |
| 2011/0298782 | A1 | 12/2011 | Park | |
| 2012/0256936 | A1 | 10/2012 | Lee et al. | |

FOREIGN PATENT DOCUMENTS

| | | |
|---|---|---|
| KR | 10-1084229 | 11/2011 |
| KR | 10-1156446 | 6/2012 |
| KR | 10-2012-0114989 | 10/2012 |
| KR | 10-2014-0137811 | 12/2014 |

* cited by examiner

FIG. 8

| | PSNR | POWER CONSUMPTION REDUCTION RATE |
|---|---|---|
| Image #1 | 52.8 dB | 14.7 % |
| Image #2 | 52.78 dB | 13.8 % |
| Image #3 | 52.83 dB | 14.1 % |

DISPLAY APPARATUS AND DISPLAY METHOD

CROSS-REFERENCE TO RELATED APPLICATION

This application claims priority to and the benefit under 35 U.S.C. §119(a) of Korean Patent Application No. 10-2014-0103629, filed on Aug. 11, 2014, the entire disclosure of which is incorporated by reference for all purposes.

BACKGROUND

Field

The following disclosure relates to a display apparatus and a displaying method, more particularly, to an organic light-emitting display apparatus and a displaying method performed by the organic light-emitting display apparatus.

Discussion of the Background

Various types of flat panel display devices capable of having reduced weights and sizes are being developed to address drawbacks of cathode ray tubes. Examples of the flat panel display devices include liquid crystal displays (LCDs), field emission displays (FEDs), plasma display devices (PDPs), and organic light-emitting displays.

LCDs and organic light-emitting displays among them are being widely used in small-sized electronic products, such as mobile phones, tablets, and laptop computers. Such small-sized electronic products use batteries, and accordingly, consumers' demand for increased working time based on a single battery charge is continuously increasing. To increase workable time of a battery, flat panel display devices, which consume a large amount of power in small-sized electronic products, need to reduce its power consumption. Flat panel display devices display images by converting digital image data into a grayscale voltage, which is analog data, and applying the grayscale voltage to pixels.

SUMMARY

Exemplary embodiments of the present invention include a display apparatus capable of reducing power consumption, and a displaying method performed by the display apparatus.

Additional aspects will be set forth in part in the description which follows and, in part, will be apparent from the description, or may be learned by practice of the presented embodiments.

According to exemplary embodiments of the present invention, a display apparatus includes a power generation unit, a control unit, a source driver, and a display panel. The control unit configured to receive image data, determine a reference grayscale value of the image data, and convert the image data to corrected data according to the reference grayscale value. The power generation unit configured to generate a first pixel driving voltage, a second pixel driving voltage corresponding to the reference grayscale value, and an analog driving voltage corresponding to the reference grayscale value. The source driver generates grayscale voltages using the analog driving voltage and output, as an image signal, a grayscale voltage corresponding to the corrected data from among the grayscale voltages. The display panel configured to receive the image signal and display an image corresponding to the image signal using the first pixel driving voltage and the second pixel driving voltage.

According to exemplary embodiments of the present invention a displaying method includes receiving image data; determining a reference grayscale value of the image data; converting the image data to corrected data based on the reference grayscale value; and generating a first pixel driving voltage, a second pixel driving voltage corresponding to the reference grayscale value, and an analog driving voltage corresponding to the reference grayscale value; generating grayscale voltages based on the analog driving voltage and outputting, as an image signal, a grayscale voltage corresponding to the corrected data from among the grayscale voltages; and displaying an image corresponding to the image signal using the first pixel driving voltage and the second pixel driving voltage.

According to exemplary embodiments of the present invention, a display apparatus includes a grayscale value extraction unit, a power generation unit, a grayscale voltage generation unit, an image signal output unit, and a display panel. The grayscale value extraction unit configured to receive image data and extract a maximum grayscale value of the image data. The power generation unit configured to generate a first pixel driving voltage, a second pixel driving voltage corresponding to the maximum grayscale value, and an analog driving voltage corresponding to the maximum grayscale value. The grayscale voltage generation unit configured to generate grayscale voltages corresponding to the maximum grayscale value by using the analog driving voltage. The image signal output unit configured to output, as an image signal, a grayscale voltage corresponding to the image data from among the grayscale voltages. The display panel configured to display an image corresponding to the image signal by using the first pixel driving voltage and the second pixel driving voltage.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

FIG. 8 is a table showing a reduction in power consumption of a display apparatus according to an exemplary embodiment of the present invention.

DETAILED DESCRIPTION OF THE ILLUSTRATED EMBODIMENTS

Figure 1:
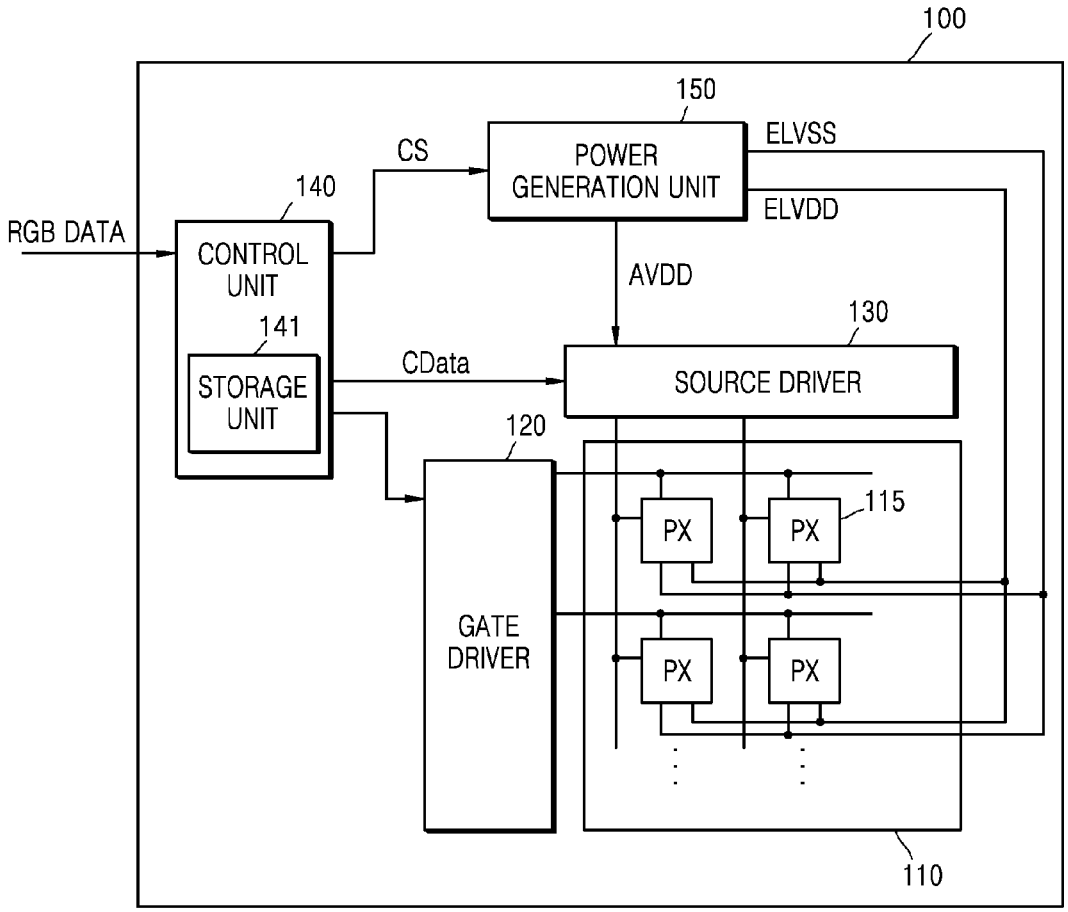
FIG. 1 is a block diagram of a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. Although some features may be described with respect to individual exemplary embodiments, aspects need not be limited thereto such that features from one or more exemplary embodiments may be combinable with other features from one or more exemplary embodiments.

It will be understood that although the terms "first", "second", etc. may be used herein to describe various components, these components should not be limited by these terms. These components are only used to distinguish one component from another. An expression used in the singular encompasses the expression in the plural, unless it has a clearly different meaning in the context. It will be further understood that the terms "comprises" and/or "comprising," or "includes" and/or "including" used herein specify the presence of stated features or components, but do not preclude the presence or addition of one or more other features or components.

Examples of flat panel display devices include, without limitation, liquid crystal displays (LCDs), field emission displays (FEDs), plasma display devices (PDPs), and organic light-emitting displays. Although exemplary embodiments will be described with respect to organic light-emitting displays, aspects of the invention are not limited thereto.

As used herein, the term "and/or" includes any and all combinations of one or more of the associated listed items. Expressions such as "at least one of" when preceding a list of elements, modify the entire list of elements and do not modify the individual elements of the list.

FIG. 1 is a block diagram of a display apparatus according to an exemplary embodiment of the present invention.

Referring to FIG. 1, a display apparatus 100 includes a display panel 110, which may display an image, a gate driver 120, a source driver 130, a control unit 140, and a power generation unit 150. The control unit 140 may be referred to as, without limitation, a timing controller.

The power generation unit 150 may generate a first pixel driving voltage ELVDD, a second pixel driving voltage ELVSS having a lower voltage level than the first pixel driving voltage ELVDD, and an analog driving voltage AVDD. The power generation unit 150 may provide or transmit the first pixel driving voltage ELVDD and the second pixel driving voltage ELVSS to the display panel 110 and the analog driving voltage AVDD to the source driver 130.

The control unit 140 is electrically connected to the gate driver 120, the source driver 130, and the power generation unit 150. The control unit 140 may receive image data RGB Data, extract a maximum grayscale value of the image data RGB Data, convert the image data RGB Data to corrected data CData according to the maximum grayscale value, and control the power generation unit 150 to generate the second pixel driving voltage ELVSS to have a first level corresponding to the maximum grayscale value and the analog driving voltage AVDD to have a second level corresponding to the maximum grayscale value. The control unit 140 may include a storage unit 141, which may store the image data RGB Data that is received by the control unit 140. The storage unit 141 may store the image data RGB Data in units of frames. Although the storage unit 141 is included in the control unit 140 in FIG. 1, aspects of the invention are not limited thereto, such that the storage unit 141 may be implemented as a separate device outside the control unit 140. Although exemplary embodiments are described with respect to a maximum grayscale value, aspects of the invention are not limited thereto, such that other reference grayscale values that are less than the maximum grayscale value may be used. Further, without limitation, levels (e.g., first level, second level, third level, and etc.,) may refer to a particular value or a range of values.

The source driver 130 may be electrically connected to the power generation unit 150 and the control unit 140. The source driver 130 may receive the analog driving voltage AVDD having the second level generated by the power generation unit 150 and the corrected data CData generated by the control unit 140. The source driver 130 may generate grayscale voltages by using the analog driving voltage AVDD having the second level. Further, the source driver 130 may output, as an image signal, a grayscale voltage corresponding to the corrected data CData from among the grayscale voltages to the display panel 110.

The gate driver 120 may be electrically connected to the control unit 140. The gate driver 120 may generate a gate pulse signal, which may also be referred to as a scan signal, under the control of the control unit 140 and output the gate pulse signal to the display panel 110.

The display panel 110 includes a plurality of pixels 115 to display an image. The display panel 110 may receive an image signal corresponding to the corrected data CData from the source driver 130 and display an image corresponding to the image signal by using the first pixel driving voltage ELVDD and the second pixel driving voltage ELVSS received from the power generation unit 150.

The control unit 140 may analyze the image data RGB Data to determine a reference grayscale value of the image data RGB Data. The reference grayscale value may be the maximum grayscale value of the image data RGB Data. However, the reference grayscale value may be determined to be a value other than the maximum grayscale value of the image data RGB Data. For example, when the maximum grayscale value of the image data RGB corresponds to full white or most white color, the reference grayscale value may be determined to be a grayscale value that is smaller than the maximum grayscale value corresponding to full white.

The control unit 140 may extract a maximum grayscale value for each frame of the image data RGB Data. The storage unit 141 may store image data RGB Data corresponding to one or more frames from among the image data RGB Data received by the control unit 140. The control unit 140 may extract a maximum grayscale value from the image data RGB Data corresponding to the one or more frames stored in the storage unit 141. Through this process, the maximum grayscale value may vary according to image data RGB Data input during different frames.

Further, the control unit 140 may analyze the image data RGB Data to determine whether the image data RGB Data is moving picture data or still image data. When the image data RGB Data is determined to be moving picture data, the control unit 140 may extract a maximum grayscale value for each frame. When the image data RGB Data is determined to be still image data, the control unit 140 may maintain a maximum grayscale value until another image data is inputted.

The control unit 140 may generate a control signal CS corresponding to a maximum grayscale value and provide or transmit the control signal CS to the power generation unit 150. According to an exemplary embodiment, when a maximum grayscale value is extracted for each frame, the control unit 140 may generate a control signal CS for each frame. The control signal CS may be used to control the power generation unit 150 so that the second pixel driving voltage ELVSS has the first level in correspondence to the maximum grayscale value and the analog driving voltage AVDD has the second level in correspondence to the maximum grayscale value.

According to aspects of the invention, the power generation unit 150 may include one or more power generation units. When the power generation unit 150 includes a first power generation unit (not shown) for generating the second pixel driving voltage ELVSS and a second power generation unit (not shown) for generating the analog driving voltage AVDD, the control signal CS may include a first control signal for controlling the first power generation unit and a second control signal for controlling the second power generation unit. The first control signal may be provided or transmitted to the first power generation unit, and the second control signal may be provided or transmitted to the second power generation unit.

The power generation unit 150 may receive the control signal CS and control the level of the second pixel driving voltage ELVSS and the level of the analog driving voltage AVDD according to the control signal CS. The power generation unit 150 may generate the second pixel driving voltage ELVSS having the first level and the analog driving voltage AVDD having the second level according to the control signal CS. According to an exemplary embodiment, the levels of the second pixel driving voltage ELVSS and the analog driving voltage AVDD produced by the power generation unit 150 may vary according to the image data RGB Data.

As the level of the second pixel driving voltage ELVSS and the level of the analog driving voltage AVDD vary, the quality of an image corresponding to the image data RGB Data may be distorted. To prevent or to protect against degradation of the quality of an image, the control unit 140 may convert (or gamma-correct) the image data RGB Data to the corrected data CData to be suitable to the environment in which the second pixel driving voltage ELVSS has the first level and the analog driving voltage AVDD has the second level. The corrected data CData generated by the control unit 140 is provided to the source driver 130, and the source driver 130 in turn provides an image signal corresponding to the corrected data CData to the pixels 115 via data lines under the control of the control unit 140. The pixels 115 may display an image corresponding to the image data RGB Data according to the image signal.

Figure 2:
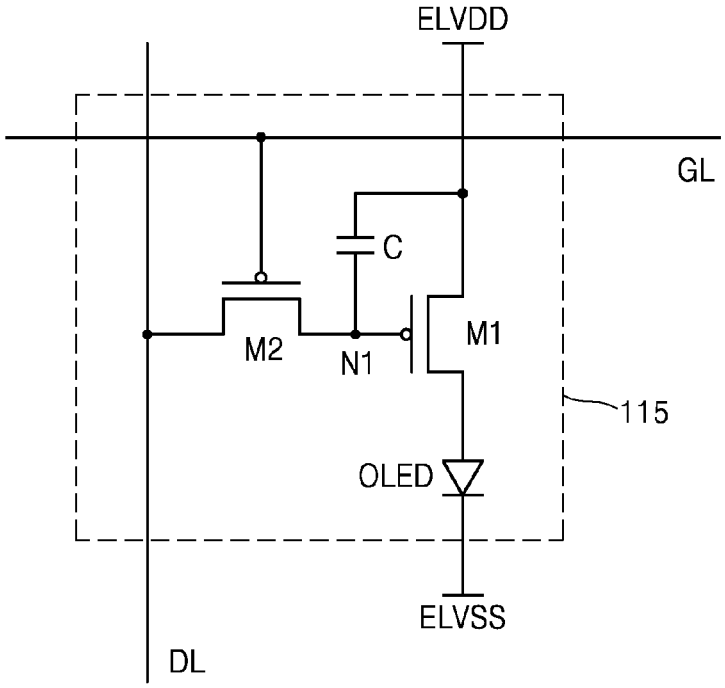
FIG. 2 is a circuit diagram of a pixel of the display apparatus of FIG. 1.

FIG. 2 is a circuit diagram of a pixel of the display apparatus of FIG. 1.

Referring to FIG. 2, the pixel 115 includes a first switch M1, a second switch M2, a capacitor C, and a light-emitting device OLED. As shown in FIG. 2, the first switch M1 and the second switch M2 may be P-type transistors. However, the pixel 115 of FIG. 1 is not limited to the pixel circuit illustrated in FIG. 2. The pixel 115 of FIG. 1 may further include a compensation circuit (not shown) for compensating for characteristics (for example, a threshold voltage) of the first and second switches M1 and M2. The pixel 115 of FIG. 1 may include at least three switches or at least two capacitors. The first and second switches M1 and M2 are not necessarily P-type transistors. At least one of the first and second switches M1 and M2 may be formed as an N-type transistor. Although not limited thereto as explained above, the first switch M1 may be described as a P-type transistor.

The display panel 110 includes a plurality of the pixels 115, and a plurality of data lines DL and a plurality of gate lines GL connected to the pixels 115. The pixels 115 may be disposed at intersections between the data lines DL and the gate lines GL and arranged in a matrix form. The data lines DL are connected to the source driver 130 of FIG. 1 and may transmit image signals from the source driver 130 to the pixels 115. The gate lines GL are connected to the gate driver 120 of FIG. 1 and may transmit scan signals from the gate driver 120 to the pixels 115.

Referring to FIG. 2, the pixel 115 is connected to a data line DL and a gate lines GL. The pixel 115 may receive the first pixel driving voltage ELVDD, and a cathode of the light-emitting device OLED may be connected to the second pixel driving voltage ELVSS. According to aspects of the invention, an anode of the light-emitting device OLED may be connected to the first pixel driving voltage ELVDD.

The first switch M1 includes a gate connected to a first node N1, a first connection terminal (for example, a source) via which the first pixel driving voltage ELVDD is received, and a second connection terminal (for example, a drain) connected to the anode of the light-emitting device OLED. The second switch M2 includes a gate connected to the gate line GL, a first connection terminal (for example, a source) connected to the data line DL, and a second connection terminal (for example, a drain) connected to the first node N1. The capacitor C is connected between the first node N1 and a line via which the first pixel driving voltage ELVDD is provided.

The second switch M2 may transmit an image signal received via the data line DL to the first node N1. More specifically, the second switch M2 may transmit the image signal in response to a scan signal received via the gate line GL. The capacitor C may store a voltage of the image signal applied to the first node N1. The first switch M1 may generate a driving current (for example, a drain current) according to a level of the voltage of the image signal stored in the capacitor C and provide or transmit the driving current to the light-emitting device OLED. The light-emitting device OLED may emit a light having a brightness corresponding to the image signal based on the driving current.

When the second switch M2 is implemented by using a P-type transistor, the second switch M2 may generate a driving current having a magnitude that is proportional to a difference between the level of the first pixel driving voltage ELVDD and a voltage level of the image signal. More specifically, as the voltage level of the image signal increases, the magnitude of the driving current may decrease, and the brightness level of light emitted by the light-emitting device OLED may be low. As the voltage level of the image signal decreases, the magnitude of the driving current may increase, and the brightness level of light emitted by the light-emitting device OLED may be high.

Referring back to FIG. 1, the image data RGB Data includes grayscale values that the pixels 115 of the display panel 110 are to respectively display. The grayscale values may include grayscale values of 0 to 255, for example, 256 grayscale values. In an example, the grayscale value of 0 may represent full black that is lowest brightness that the display panel 110 can display, and the grayscale value of 255 may represent full white or the highest brightness that the display panel 110 can display. A gray color may denote a grayscale value that is neither full black nor full white (e.g., grayscale values of 1 to 254). More specifically, in some application products, gray color may denote grayscale values that are not full white (i.e., grayscale values of 0 to 254). Although not limited thereto, grayscale values of the image data RGB Data range may be described as being from 0 to 255, in which a grayscale value of 0 may represent full black, and a grayscale value of 255 may represent full white. However, if there are 1024 grayscale values, the grayscale values of the image data RGB Data may range from 0 to 1023.

The source driver 130 may generate the grayscale voltages in order to output image signals corresponding to the grayscale values of the image data RGB Data. The grayscale voltages may be referred to as gamma voltages.

Figure 3:
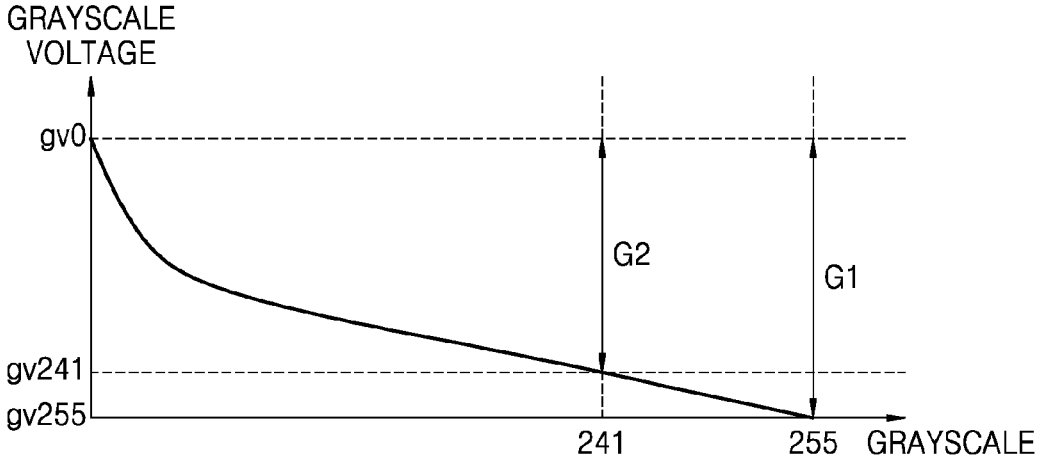
FIG. 3 is a graph showing a gamma curve of a display apparatus according to an exemplary embodiment of the present invention.

FIG. 3 is a graph showing a gamma curve of a display apparatus according to an exemplary embodiment of the present invention.

FIG. 3 illustrates grayscale voltages versus grayscale values. The graph of FIG. 3 may be referred to as a gamma curve. The graph of FIG. 3 may illustrate a gamma curve that is applied when the pixels 115 of the display panel 110 include P-type transistors as driving transistors. The graph of FIG. 3 is an example, and thus may vary according to the circuit structure of each pixel 115.

As shown in FIG. 3, as a grayscale value increases (e.g., as grayscale value approaches 255), the level of a grayscale voltage decreases. As a grayscale value decreases (e.g., as grayscale value approaches 0), the level of a grayscale voltage increases. To express all of the grayscale values ranging from a grayscale value of 0 to a grayscale value of 255, the grayscale voltages have voltage levels ranging from a voltage level gv0 corresponding to the grayscale value of 0 to a voltage level gv255 corresponding to the grayscale value of 255. More specifically, to express or display all of the gray scale values from a grayscale value range of 0 to 255, the grayscale voltages having the levels in a first range G1 may be used.

If a maximum or reference grayscale value from among the grayscale values of the image data RGB Data is a grayscale value of 241 (e.g., where a maximum grayscale value is 241), the grayscale voltages may have voltage levels ranging from the voltage level gv0 corresponding to the grayscale value of 0 to a voltage level gv241 corresponding to a grayscale value of 241. More specifically, to express or display all of the gray scale values from a grayscale value range of 0 to 241, the grayscale voltages having the levels in a second range G2 may be used.

The grayscale voltages may be generated using the analog driving voltage AVDD generated by the power generation unit 150. For example, the grayscale voltages may be generated by dividing the analog driving voltage AVDD by using resistors (not shown) that may be serially connected to each other. The analog driving voltage AVDD may have a level or value that is equal to or higher than the voltage level or value gv0 corresponding to the grayscale value of 0.

When the maximum grayscale value of the image data RGB Data is the grayscale value of 241, which is lower than the gray scale of 255, only the grayscale voltages having the levels in the second range G2 may be provided, which is narrower than the first range G1, as shown in FIG. 3. According to exemplary embodiments, the level of the analog driving voltage AVDD may be decreased in correspondence to the second range G2. As the level of the analog driving voltage AVDD may be decreased, power consumption of the power generation unit 150 may decrease.

A method for performing gamma correction to reduce power consumption without or reduced degradation of the quality of an image by decreasing the level of the analog driving voltage AVDD and increasing the level of the second pixel driving voltage ELVSS when the maximum grayscale value of the image data RGB Data is lower than the grayscale value of 255 will now be described in detail with reference to FIGS. 4A-4D. With respect to FIGS. 4A-4D, although not limited, the maximum or reference grayscale value of the image data RGB Data will be described as being 241. However, aspects of the invention may have a maximum or reference grayscale value different than 241.

When the maximum or reference grayscale value of the image data RGB Data is 255 (e.g., full white), the level of the second pixel driving voltage ELVSS may be referred to as a third level, and the level of the analog driving voltage AVDD may be referred to as a fourth level. The third level of the second pixel driving voltage ELVSS may be lower than a ground voltage level. According to exemplary embodiments, when the level of the second pixel driving voltage ELVSS is increased to be higher than the third level, it approaches the ground voltage level, and thus power consumption may additionally be reduced.

Figure 4A:
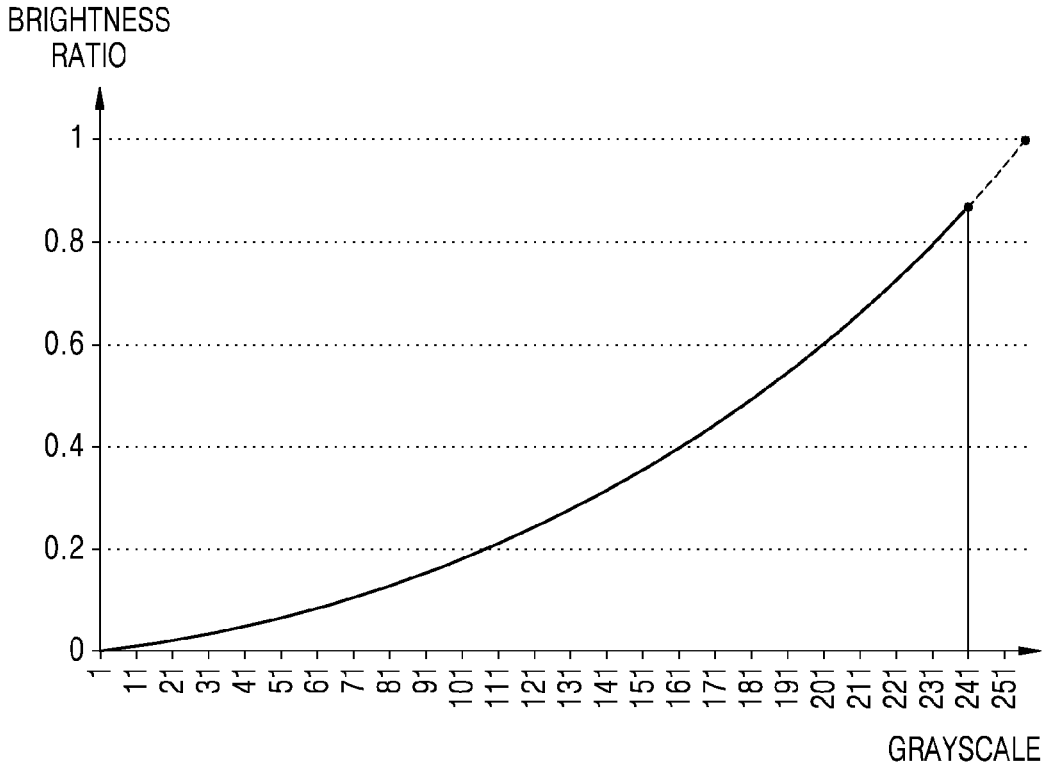
FIG. 4A is a graph showing a relationship between a brightness ratio and a grayscale value according to an exemplary embodiment of the present invention.

FIG. 4A is a graph showing a brightness ratio versus a grayscale value according to an exemplary embodiment of the present invention.

Referring to FIG. 4A, the brightness ratio may increase with an increase in the grayscale value. In the graph of FIG. 4A, the y axis (e.g., the brightness ratio) indicates a brightness ratio of brightness corresponding to each grayscale value with respect to brightness. For example, 450 nit may correspond to the grayscale value of 255, which may, for example, be full white.

When the maximum grayscale value of the image data RGB Data is 241, an image may be displayed with a brightness that is lower than brightness (for example, 425 nit) corresponding to the grayscale value of 241. More specifically, an image may not be displayed with brightness that is higher than the brightness corresponding to the grayscale value of 241. Since there is no need to display the brightness that is higher than the brightness corresponding to the grayscale value of 241 when the maximum grayscale value of the image data RGB Data is 241, the level of the analog driving voltage AVDD may be decreased.

For example, when the maximum grayscale value of the image data RGB Data is 255, the level of the analog driving voltage AVDD (e.g., the fourth level) may be, for example, 7.8 V. When the maximum grayscale value of the image data RGB Data is 241, the level of the analog driving voltage AVDD (e.g., the second level) may be, for example, 7.27 V. The second level of the analog driving voltage AVDD is lower than the fourth level thereof by about 530 mV, and a reduction of power consumption by about 11% may be obtained.

As the maximum grayscale value of the image data RGB Data decreases, the range of brightness used to display an image corresponding to the image data RGB Data may be decreased. Thus, the second level of the analog driving voltage AVDD may decrease.

Figure 4B:
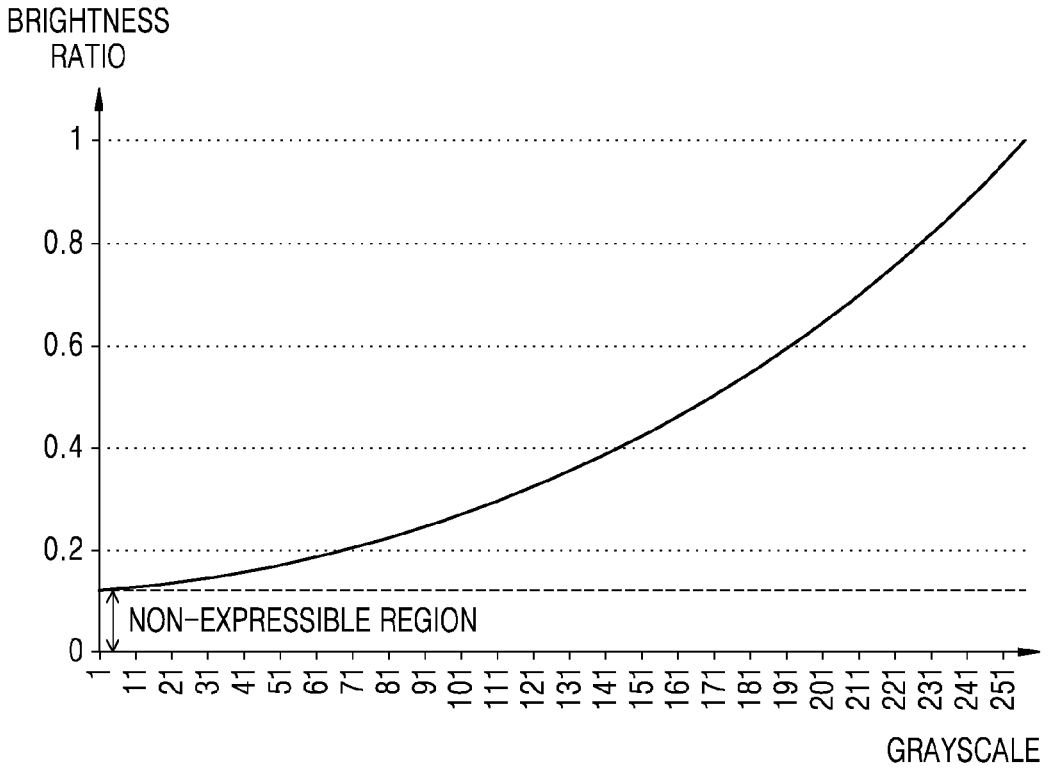
FIG. 4B is a graph showing a relationship between a brightness ratio and a grayscale value when a level of an analog driving voltage is changed according to an exemplary embodiment of the present invention.

FIG. 4B is a graph showing a relationship between a brightness ratio and a grayscale value when a level of the analog driving voltage is changed according to an exemplary embodiment of the present invention.

Referring to FIG. 4B, when the level of the analog driving voltage AVDD is decreased from the fourth level to the second level, high brightness may be expressed, but low brightness may not be expressed. When the level of the analog driving voltage AVDD is decreased, the levels of the grayscale voltages generated using the analog driving voltage AVDD may also be entirely decreased. As described above with reference to FIG. 2, the pixel 151 including a P-type driving transistor may emit a light with lower brightness as the voltage level of the image signal increases and emit a light with higher brightness as the voltage level of the image signal decreases. Based on the decreasing of the level of the analog driving voltage AVDD, grayscale voltages having high levels may not be applied to the pixels 151, and the pixels 151 may be unable to express a range of low brightness as exemplified by the non-expressional region of FIG. 4B.

For example, when the maximum grayscale value is 241 and the level of the analog driving voltage AVDD is decreased to the second level in correspondence to the maximum grayscale value of 241, grayscale values in a low grayscale region where the brightness ratio ranges from 0% to about 5.5% may not be expressed, as shown in FIG. 4B.

Figure 4C:
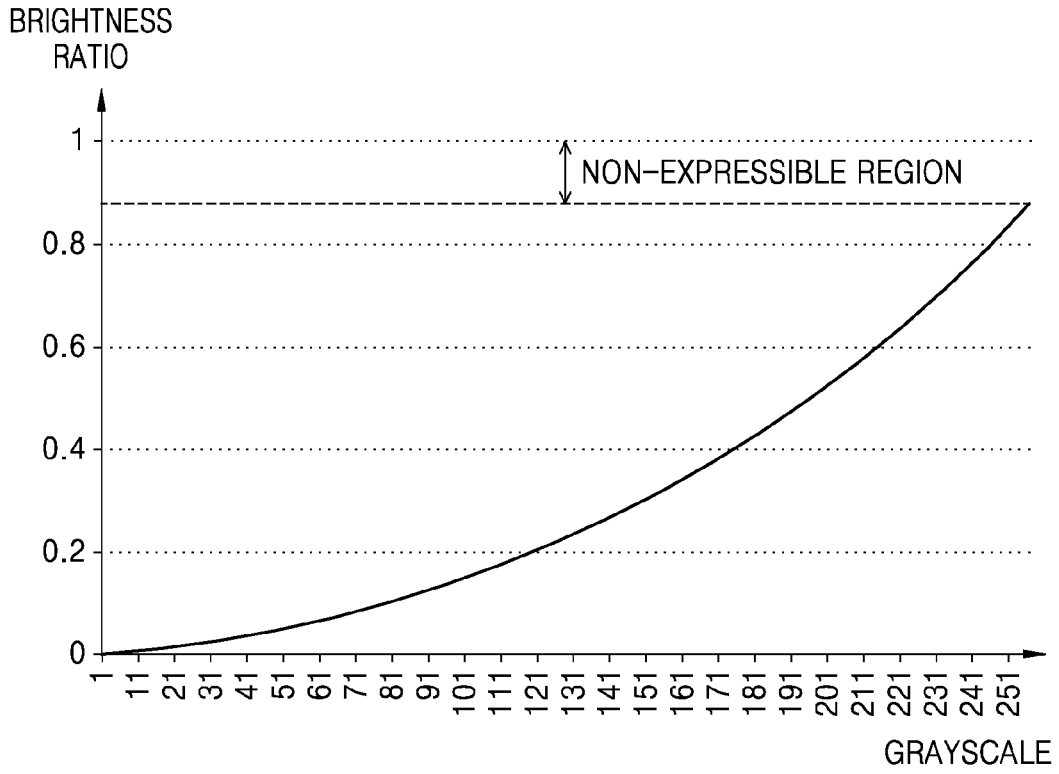
FIG. 4C is a graph showing a relationship between a brightness ratio and a grayscale value when a level of a second pixel driving voltage is changed according to an exemplary embodiment of the present invention.

FIG. 4C is a graph showing a relationship between a brightness ratio and a grayscale value when a level of a second pixel driving voltage is changed according to an exemplary embodiment of the present invention.

Referring to FIG. 4C, when the level of the second pixel driving voltage ELVSS is increased from the third level to the first level, high brightness may not be expressed, but low brightness may be expressed. More specifically, when the level of the second pixel driving voltage ELVSS applied to the cathode of the light-emitting device OLED is increased, the magnitude of the driving current of the pixel 151 may be reduced, and brightness range that the pixel 151 can display may be decreased. When the level of the second pixel driving voltage ELVSS is increased to the first level in correspondence with the decreasing of the level of the analog driving voltage AVDD to the second level, the grayscale values in the non-expressible low grayscale region of FIG. 4B may be expressed as illustrated in FIG. 4C.

For example, when the level of the second pixel driving voltage ELVSS is changed to the first level, which is higher than the third level by, for example, 1.5V, to express the low grayscale region (for example, 0 nit to 25 nit) where the brightness ratio is 0% to about 5.5%, the entire brightness may be decreased by 25 nit. Thus, as shown in FIG. 4C, a non-expressible grayscale region is changed to a high grayscale region. Accordingly, a brightness level that is higher than, for example, 425 nit, may not be expressed, whereas brightness range of, for example, 0 nit to 25 nit, may be expressed. If brightness corresponding to the grayscale value of 241 is, for example, 425 nit, the image data RGB Data having a maximum grayscale value of 241 may be entirely displayed. Moreover, when the level of the second pixel driving voltage ELVSS is increased by 1.5V, power consumption of the power generation unit 150 may be reduced about 15%.

As the maximum grayscale value of the image data RGB Data decreases, the second level of the analog driving voltage AVDD may decrease, and the non-expressible low grayscale region may widen. Therefore, when brightness is to be lowered further, the first level of the second pixel driving voltage ELVSS may be increased.

Figure 4D:
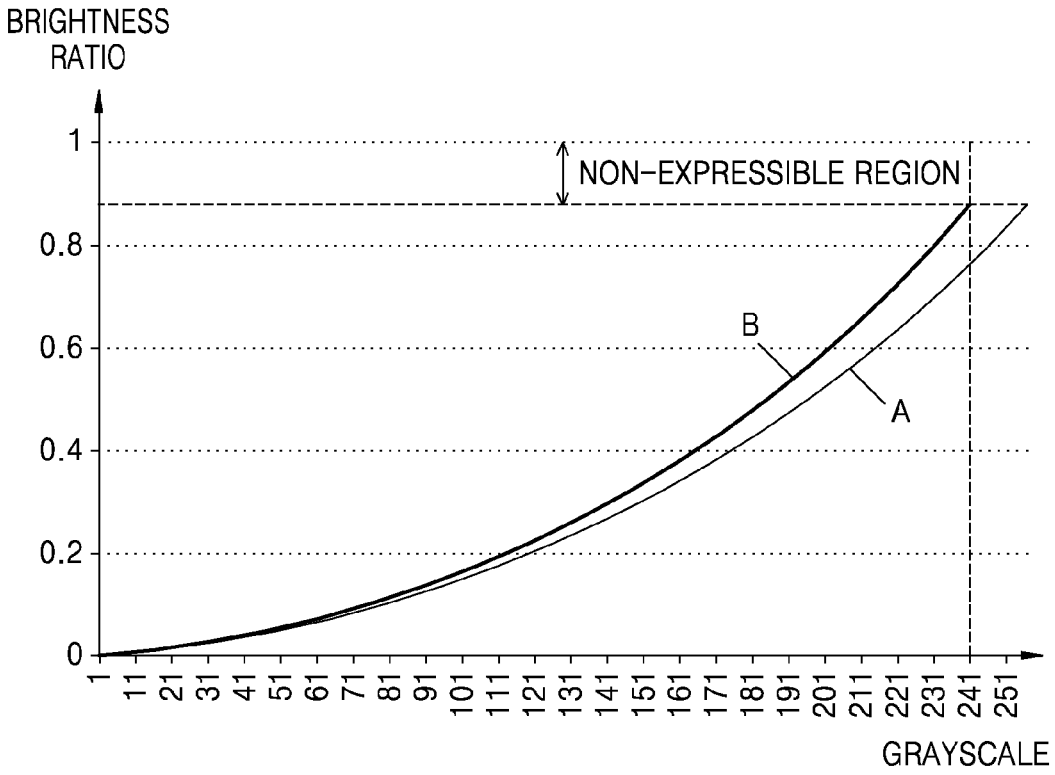
FIG. 4D is a graph showing a relationship between inputted image data and corrected data in correspondence to a changed level of an analog driving voltage and a changed level of a second pixel driving voltage according to an exemplary embodiment of the present invention.

FIG. 4D is a graph showing a relationship between inputted image data and corrected data in correspondence to a changed level of an analog driving voltage and changed level of a second pixel driving voltage according to an exemplary embodiment of the present invention.

More specifically, in an example, the analog driving voltage AVDD may be decreased to the second level and the second pixel driving voltage ELVSS may be increased to the first level. Referring to FIG. 4D, curve A of FIG. 4D is the same as the curve of FIG. 4C. According to the curve A, 425 nit, for example, may be expressed at the grayscale value of 255. However, when the maximum grayscale value of the image data RGB Data is 241, 425 nit should be expressed at the grayscale value of 241. Moreover, since the level of the analog driving voltage AVDD and the level of the second pixel driving voltage ELVSS have been changed, the curve A may not have a constant gamma (for example, 2.2 gamma). Because of this problem, if the image data RGB Data is not corrected, the quality of an image may be degraded.

A curve B of FIG. 4D may be a curve obtained by gamma-correcting the curve A. According to the curve B, 425 nit may be expressed at the grayscale value of 241. The curve B may be set to have a constant gamma (for example, 2.2 gamma).

Referring to FIG. 1, the image data RGB Data may be expressed on the display panel 110 with an accurate grayscale value in the environment where the level of the analog driving voltage AVDD is the fourth level and the level of the second pixel driving voltage ELVSS is the third level. As described above, however, when the maximum grayscale value of the image data RGB Data is a value less than 255 (for example, 241), the level of the analog driving voltage AVDD may be changed to the second level in correspondence to the maximum grayscale value and the level of the second pixel driving voltage ELVSS may be changed to the first level in correspondence to the maximum grayscale value (for example, 241). The image data RGB Data may be converted to the corrected data CData by the control unit 140 to be suitable to the environment where the grayscale voltages are generated using the analog driving voltage AVDD having the second level and the second pixel driving voltage ELVSS having the first level is applied to the display panel 110.

FIGS. 5A, 5B, 5C, and 5D are views illustrating a changed level of the analog driving voltage, a changed level of the second pixel driving voltage, and corrected image data RGB Data according to exemplary embodiments of the present invention.

Figure 5A:
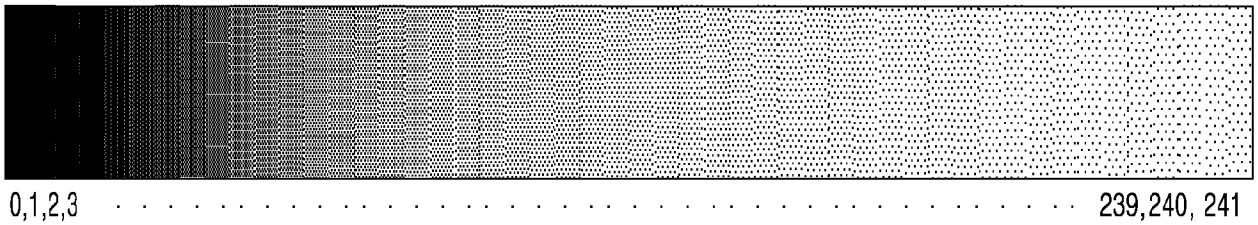
FIGS. 5A, 5B, 5C, and 5D are views illustrating a changed level of the analog driving voltage, a changed level of the second pixel driving voltage, and corrected image data in correspondence with a maximum grayscale value according to exemplary embodiments of the present invention.

FIG. 5A illustrates an image corresponding to the image data RGB Data. The image data RGB Data is an image having a maximum or reference grayscale value of, for example, 241. The leftmost region of FIG. 5A is expressed with a grayscale value of 0, and the rightmost region thereof is expressed with a grayscale value of 241.

Figure 5B:
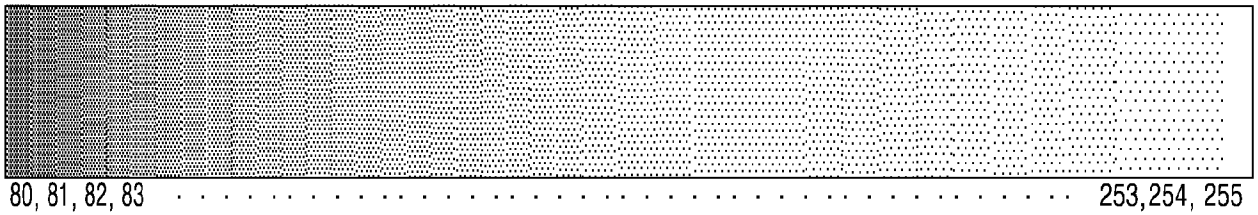

FIG. 5B illustrates an image obtained after the level of the analog driving voltage AVDD is decreased to the second level in correspondence to the maximum or reference grayscale value. As described above with reference to FIG. 4B, as the level of the analog driving voltage AVDD is decreased, brightness in a low grayscale region may not expressed. The leftmost region of FIG. 5B is expressed with a grayscale value of 80, and the rightmost region thereof is expressed with a grayscale value of 255.

Figure 5C:
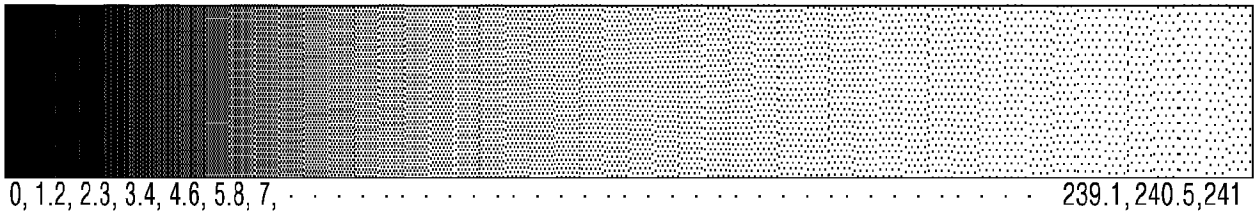

FIG. 5C illustrates an image obtained after the level of the second pixel driving voltage ELVSS is increased to the first level in correspondence to the maximum grayscale value. As described above with reference to FIG. 4C, as the level of the second pixel driving voltage ELVSS is increased in correspondence to a change in the level of the analog driving voltage AVDD, the brightness of the image may entirely decrease. Accordingly, brightness in a high grayscale region or above a certain grayscale may not be expressed. The leftmost region of FIG. 5C is expressed with a grayscale value of 0, and the rightmost region thereof may be expressed with a grayscale value of 241. However, in the middle region of FIG. 5C, brightness corresponding to grayscale values may not be expressed.

Figure 5D:
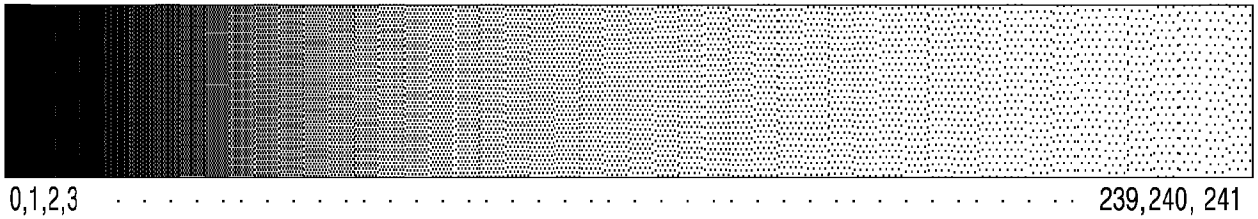

FIG. 5D illustrates an image obtained after the image data RGB Data is corrected to the corrected data CData in correspondence to the maximum grayscale value. As described above with reference to FIG. 4D, the same image as the image of FIG. 5A may be displayed by converting the image data RGB Data to the corrected data CData in correspondence to changes in the level of the analog driving voltage AVDD and the level of the second pixel driving voltage ELVSS.

Although the maximum grayscale value of the image data RGB Data is 241 described in FIGS. 5A-5D, aspects of the invention are not limited thereto, such that the maximum grayscale value of the image data RGB Data may vary according to frames. As the maximum grayscale value decreases, the first level of the second pixel driving voltage ELVSS may increase, and the second level of the analog driving voltage AVDD may decrease. Further, as the maximum grayscale value increases, the first level of the second pixel driving voltage ELVSS may decrease, and the second level of the analog driving voltage AVDD may increase. When the maximum grayscale value is a value corresponding to full white (for example, 255), the level of the second pixel driving voltage ELVSS may be decreased to the third level, and the level of the analog driving voltage AVDD may be increased to the fourth level.

Figure 6:
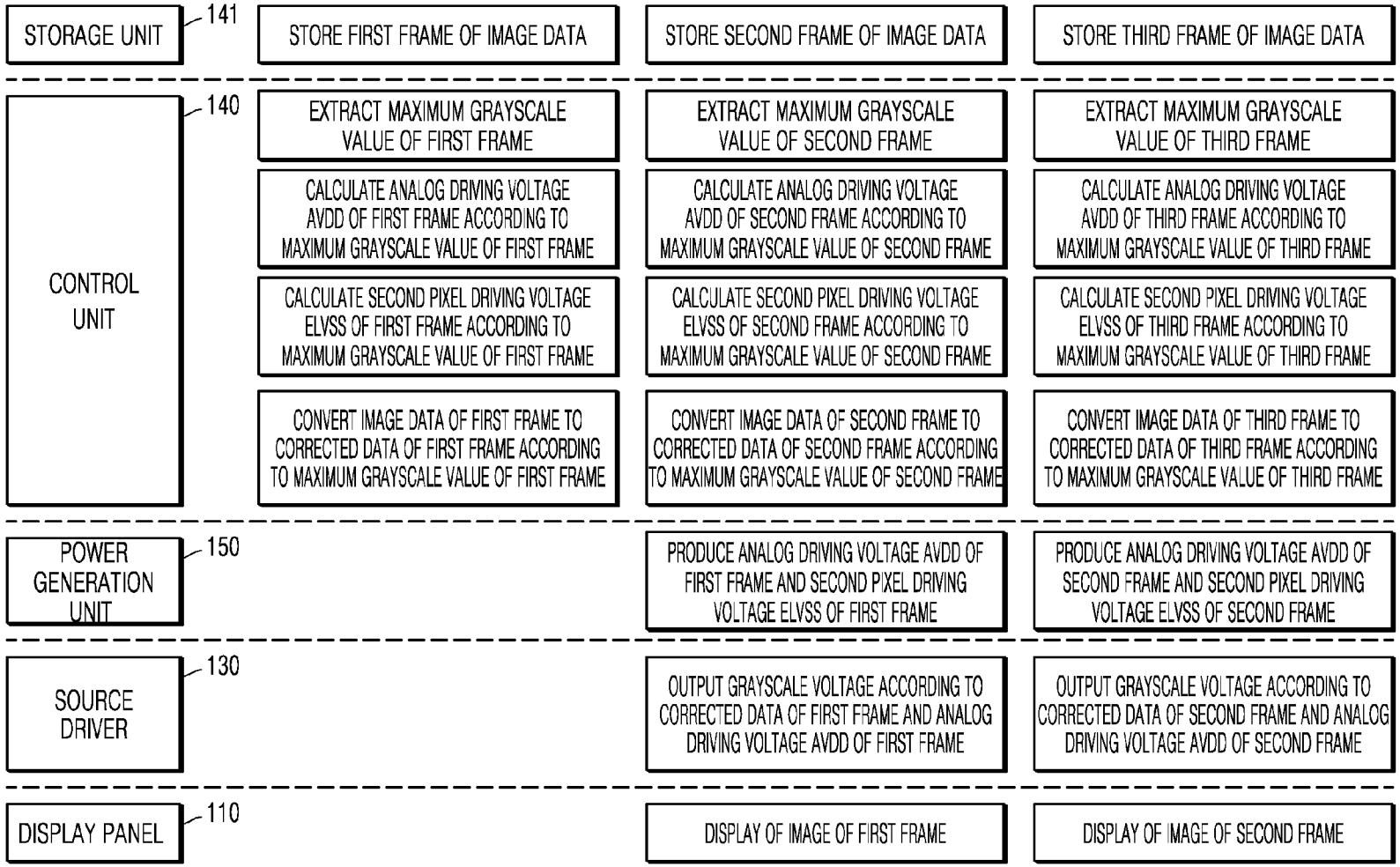
FIG. 6 is a block diagram for explaining a displaying method according to an exemplary embodiment of the present invention.

FIG. 6 is a block diagram for explaining a displaying method according to an exemplary embodiment of the present invention.

FIG. 6 illustrates operations respectively performed by the storage unit 141, the control unit 140, the power generation unit 150, the source driver 130, and the display panel 110 during each frame. Although the maximum or reference grayscale value differs according to different frames, and accordingly, the levels of the analog driving voltage AVDD and the second pixel driving voltage ELVDD are changed in FIG. 6, this is only an example and aspects of the invention are not limited thereto. At a different interval (for example, at intervals of several frames or one second), the maximum grayscale value may be changed and accordingly the levels of the analog driving voltage AVDD and the second pixel driving voltage ELVDD may be changed. Further, when a still image is changed to another still image, the maximum grayscale value may be changed and the levels of the analog driving voltage AVDD and the second pixel driving voltage ELVDD may be changed.

The control unit 140 may receive the image data RGB Data. When image data of a first frame is received, the control unit 140 may store the image data of the first frame in the storage unit 141. The control unit 140 may analyze the image data of the first frame stored in the storage unit 141 and extract a maximum grayscale value of the image data of the first frame.

The control unit 140 may determine a level of the second pixel driving voltage ELVSS and a level of the analog driving voltage AVDD that correspond to the maximum grayscale value of the first frame. The control unit 140 may include a memory that stores information about levels of the second pixel driving voltage ELVSS and levels of the analog driving voltage AVDD that correspond to maximum or reference grayscale values of the respective frames or images. When the maximum grayscale value of the first frame is extracted, the control unit 140 may determine the level of the second pixel driving voltage ELVSS and the level of the analog driving voltage AVDD by reading information corresponding to the maximum or reference grayscale value of the first frame from the memory.

The control unit 140 may convert or gamma-correct the image data of the first frame to corrected data of the first frame in correspondence to the maximum grayscale value of the first frame. The control unit 140 may convert the image data of the first frame to the corrected data of the first frame by using an equation including the maximum grayscale value of the first frame. According to exemplary embodiments, the control unit 140 may include a memory that stores mapping tables of pieces of image data and pieces of corrected data that respectively correspond to maximum grayscale values. The control unit 140 may read a mapping table corresponding to the maximum grayscale value of the first frame from the memory and convert the image data of the first frame to the corrected data of the first frame by using the read-out mapping table.

When image data of a second frame is received, the control unit 140 may control the power generation unit 150 by using the control signal CS to generate the second pixel driving voltage ELVSS and the analog driving voltage AVDD, respectively, having levels corresponding to the maximum grayscale value of the second frame. The power generation unit 150 may generate a second pixel driving voltage ELVSS having a first frame level corresponding to the maximum grayscale value of the first frame and an analog driving voltage AVDD having the first frame level corresponding to the maximum grayscale value of the first frame. The power generation unit 150 may output the second pixel driving voltage ELVSS having the first level to the display panel 110 and output the analog driving voltage AVDD having the second level to the source driver 130.

The control unit 140 may output the corrected data of the first frame to the source driver 130. The source driver 130 may receive the analog driving voltage AVDD having the first frame level and generate grayscale voltages by using the analog driving voltage AVDD having the first frame level. The source driver 130 may receive the corrected data of the first frame, select a grayscale voltage corresponding to the corrected data of the first frame from among the generated grayscale voltages, and output the selected grayscale voltage, as an image signal, to the display panel 110.

The display panel 110 may receive the image signal from the source driver 130 and display an image corresponding to the image data of the first frame via the pixels 151. The pixels 151 may display the image by using the second pixel driving voltage ELVSS having the first frame level and the first pixel driving voltage ELVDD having a level higher than the level of the second pixel driving voltage ELVSS, which may be generated by the power generation unit 150.

While the display panel 110 is displaying the image corresponding to the image data of the first frame, the power generation unit 150 may generate the second pixel driving voltage ELVSS having the first level, output the same to the display panel 110, generate the analog driving voltage AVDD having the second level, and output the same to the source driver 130. At this time, the control unit 140 may store the image data of the second frame in the storage unit 141. The control unit 140 may extract a maximum grayscale value of the second frame from the image data of the second frame, determine a level of the second pixel driving voltage ELVSS and a level of the second pixel driving voltage ELVSS in correspondence to the maximum grayscale value of the second frame, and convert the image data of the second frame to corrected data of the second frame.

When the image data of the third frame is received, under the control of the control unit 140, the power generation unit 150 may generate a second pixel driving voltage ELVSS having a second frame level in correspondence to the maximum grayscale value of the second frame and output the second pixel driving voltage ELVSS to the display panel 110, and may generate an analog driving voltage AVDD having a second frame level in correspondence to the maximum grayscale value of the second frame and output the analog driving voltage AVDD to the source driver 130. The source driver 130 may generate grayscale voltages corresponding to the maximum grayscale value of the second frame by using the analog driving voltage AVDD having the second frame level and output, as an image signal, a grayscale voltage corresponding to the corrected data of the second frame from among the grayscale voltages to the display panel 110. The display panel 110 may receive the image signal from the source driver 130 and display an image corresponding to the image data of the second frame via the pixels 151.

While the display panel 110 is displaying the image corresponding to the image data of the second frame, the control unit 140 may receive image data of a third frame and store the image data in the storage unit 141. The display apparatus 100 may control the level of the second pixel driving voltage ELVSS and the level of the second pixel driving voltage ELVSS in correspondence to the maximum grayscale value of each frame while displaying the image corresponding to the image data RGB Data, thereby reducing power consumption.

Figure 7:
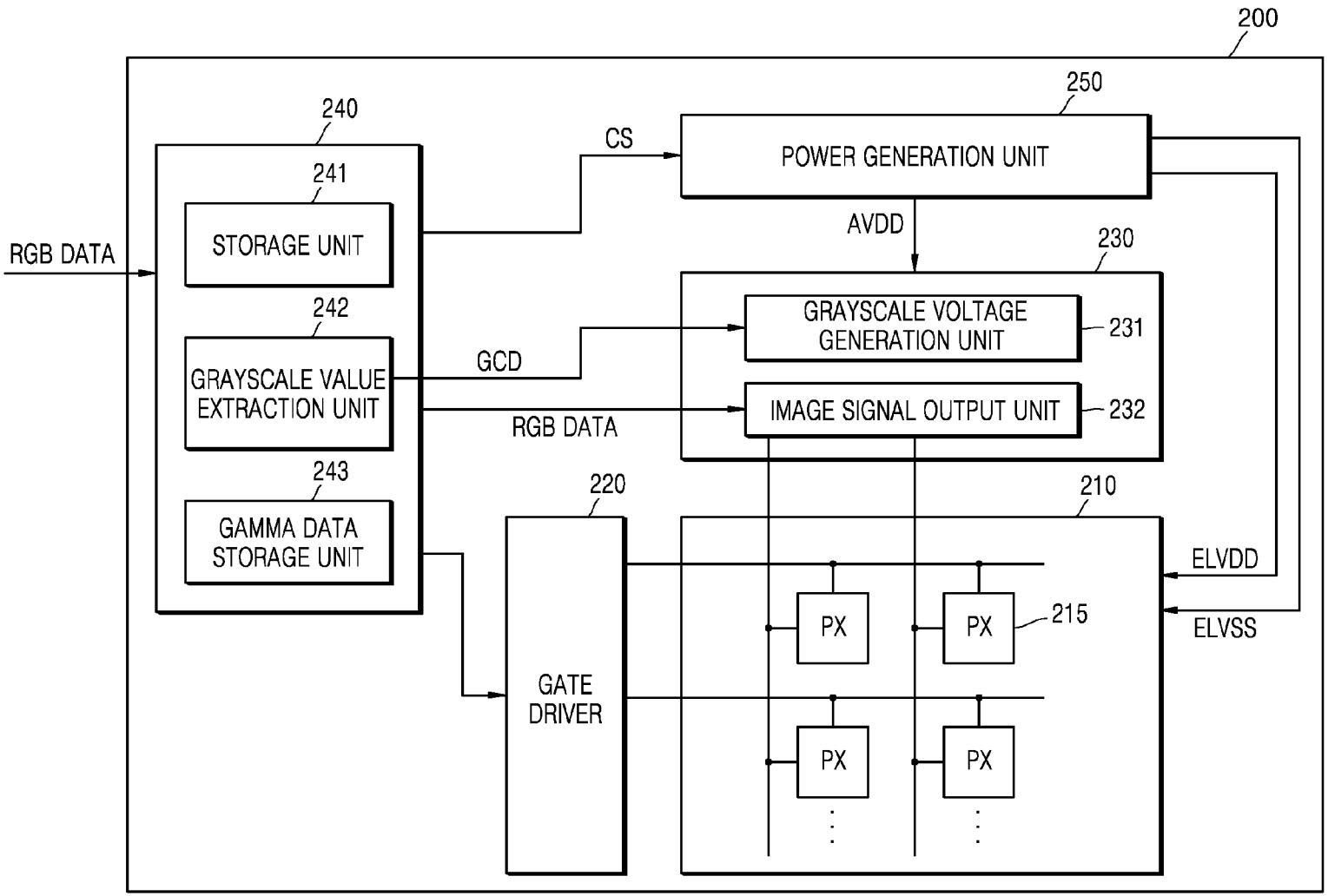
FIG. 7 is a block diagram of a display apparatus according to an exemplary embodiment of the present invention.

FIG. 7 is a block diagram of a display apparatus according to an exemplary embodiment of the present invention.

Referring to FIG. 7, the display apparatus 200 includes a grayscale value extraction unit 242, a power generation unit 250, a grayscale voltage generation unit 231, an image signal output unit 232, and a display panel 210. The maximum grayscale value extraction unit 242 may receive image data RGB Data and extract a maximum or reference grayscale value of the image data RGB Data. The grayscale value extraction unit 242 may generate a control signal CS corresponding to the maximum grayscale value. The power generation unit 250 may generate a first pixel driving voltage ELVDD, a second pixel driving voltage ELVSS having a first level corresponding to the maximum grayscale value, and an analog driving voltage AVDD having a second level corresponding to the maximum grayscale value. The power generation unit 250 may change the level of the second pixel driving voltage ELVSS to the first level and the level of the analog driving voltage AVDD to the second level, in response to the control signal CS.

The grayscale voltage generation unit 231 may generate grayscale voltages corresponding to the maximum grayscale value, by using the analog driving voltage AVDD. The image signal output unit 232 may output, as an image signal, a grayscale voltage corresponding to the image data RGB Data from among the grayscale voltages. The display panel 210 may display an image corresponding to the image signal by using the first pixel driving voltage ELVDD and the second pixel driving voltage ELVSS.

The maximum grayscale value extraction unit 242 may be included in the control unit 240. The control unit 240 may include a storage unit 241, which may store the image data RGB Data in units of frames. The storage unit 241 may store the image data RGB Data in units of frames. The control unit 240 may correspond to the control unit 140 of FIG. 1.

The grayscale voltage generation unit 231 and/or the image signal output unit 232 may be included in the source driver 230. The grayscale voltage generation unit 231 may be disposed outside the source driver 230 and may provide or transmit the grayscale voltages to the source driver 230. The source driver 230 may correspond to the source driver 130 of FIG. 1.

The power generation unit 250, the gate driver 220, and the display panel 210 may correspond to the power generation unit 150, the gate driver 120, and the display panel 110 of FIG. 1, respectively. The display panel 210 includes a plurality of pixels 215, which may display images. Descriptions of components of FIG. 7 substantially corresponding to those of the display apparatus 100 of FIG. 1 will not be repeated herein.

The display apparatus 200 may further include a gamma data storage unit 243, which may respectively store pieces of gamma curve data corresponding to maximum grayscale values. The gamma data storage unit 243 may be included in the control unit 240.

The grayscale voltage generation unit 231 may generate grayscale voltages that are adequate for the environment where the second pixel driving voltage ELVSS has the first level and the analog driving voltage AVDD has the second level. More specifically, the grayscale voltage generation unit 231 may generate the gray scale voltages by using gamma curve data GCD that correspond to the maximum grayscale value of the image data RGB Data. The gamma curve data GCD may be read from the gamma data storage unit 243. According to an exemplary embodiment, when the maximum grayscale value extraction unit 242 extracts the maximum grayscale value of the image data RGB Data, the control unit 240 may read gamma curve data GCD corresponding to the maximum grayscale value from the gamma data storage unit 243, and control the grayscale voltage generation unit 231 to generate, by using the gamma curve data GCD, the grayscale voltages suitable to the environment where the analog driving voltage AVDD has the second level and the second pixel driving voltage ELVSS has the first level.

The image signal output unit 232 may receive the grayscale voltages from the grayscale voltage generation unit 231 and output, as an image signal, a grayscale voltage corresponding to the image data RGB Data, which may be received from the control unit 240, from among the grayscale voltages to the display panel 210. The display apparatus 200 may reduce the amount of data processed by the control unit 240, by not gamma-correcting the image data RGB Data but gamma-correcting the grayscale voltages.

According to aspects of the invention, the second pixel driving voltage ELVSS may be configured to have the first level and the analog driving voltage AVDD may be configured to have the second level in correspondence to the maximum grayscale value to reduce a driving voltage of the source driver 230 and a driving voltage of the display panel 210. Therefore, overall power consumption of the display apparatus 200 may be reduced.

FIG. 8 is a table showing a reduction in power consumption of a display apparatus according to an exemplary embodiment of the present invention.

Referring to FIG. 8, a display apparatus according to an exemplary embodiment reduced power consumption by about 14% in comparison to a conventional display apparatuses that do not perform the operation of controlling the level of the second pixel driving voltage ELVSS and the level of the analog driving voltage AVDD according to the maximum grayscale value of the image data RGB Data. Moreover, viewers may not be aware of any difference between the quality of an image displayed by the display apparatus according to an exemplary embodiment and the qualities of images displayed by conventional display apparatuses. A peak signal to noise ratio (PSNR) of FIG. 8 may represent a difference between images respectively displayed on two display apparatuses when the same image data is inputted to the two display apparatuses. If there is no difference between the two images, the PSNR may be infinite. If the PSNR is 40 dB or greater, a viewer may be unable to see any difference. Since the PSNR shown in FIG. 8 is about 52.8 dB, the quality of an image displayed by the display apparatus according to an exemplary embodiment may not degraded from the qualities of images displayed by conventional display apparatuses. Therefore, display apparatuses according to exemplary embodiments may reduce power consumption without degrading the quality of an image displayed thereon.

It should be understood that the exemplary embodiments described therein should be considered in a descriptive sense only and not for purposes of limitation. Descriptions of features or aspects within each embodiment should typically be considered as available for other similar features or aspects in other embodiments.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a controller configured to receive image data for one or more frames, determine one reference grayscale value of the image data, and convert the image data to corrected data according to the reference grayscale value;

a power generator configured to generate a first pixel driving voltage, a second pixel driving voltage corresponding to the reference grayscale value, and an analog driving voltage corresponding to the reference grayscale value;

a source driver configured to generate grayscale voltages using the analog driving voltage and output, as an image signal, a grayscale voltage corresponding to the corrected data from among the grayscale voltages; and a display panel configured to receive the image signal and display an image corresponding to the image signal using the first pixel driving voltage and the second pixel driving voltage, wherein:

when the reference grayscale value corresponds to gray, the second pixel driving voltage has a first level, and the analog driving voltage has a second level, and when the reference grayscale value corresponds to full white, the second pixel driving voltage has a third level and the analog driving voltage has a fourth level, wherein the first level is higher than the third level, and the second level is lower than the fourth level.

2. The display apparatus of claim 1, wherein the controller is configured to generate a control signal for controlling the power generator, and the power generator is configured to receive the control signal and generate the second pixel driving voltage having a first level and the analog driving voltage having a second level according to the control signal.

3. The display apparatus of claim 1, further comprising data storage configured to store the one or more frames of the image data.

4. The display apparatus of claim 3, wherein the controller is configured to extract a maximum grayscale value from one of the stored frames of the image data and sets the maximum grayscale value as the reference grayscale value.

5. The display apparatus of claim 3, wherein, while the display panel is displaying an image corresponding to the one of the stored frames of the image data, the second pixel driving voltage is applied to the display panel and the analog driving voltage is applied to the source driver.

6. The display apparatus of claim 1, wherein, when the reference grayscale value decreases, the first level of the second pixel driving voltage increases and the second level of the analog driving voltage decreases.

7. The display apparatus of claim 1, wherein the display panel comprises a plurality of pixels, and each of the plurality of pixels comprises a P-type transistor configured to generate a driving current having a magnitude that decreases as a voltage level of the image signal increases.

8. A displaying method, comprising:

receiving image data for one or more frames;

determining one reference grayscale value of the image data;

converting the image data to corrected data based on the reference grayscale value;

generating a first pixel driving voltage, a second pixel driving voltage corresponding to the reference grayscale value, and an analog driving voltage corresponding to the reference grayscale value;

generating grayscale voltages based on the analog driving voltage and outputting, as an image signal, a grayscale voltage corresponding to the corrected data from among the grayscale voltages; and displaying an image corresponding to the image signal using the first pixel driving voltage and the second pixel driving voltage, wherein, when the reference grayscale value corresponds to gray, the second pixel driving voltage has a level that is higher than a level that the second pixel driving voltage has when the reference grayscale value is a value corresponding to full white, and the analog driving voltage has a level that is lower than a level that the analog driving voltage has when the reference grayscale value is the value corresponding to full white.

9. The displaying method of claim 8, wherein the determining of the reference grayscale value comprises generating a control signal corresponding to the reference grayscale value, and the generating of the second pixel driving voltage and the analog driving voltage comprises receiving the control signal and generating the second pixel driving voltage having a first level and the analog driving voltage having a second level according to the control signal.

10. The displaying method of claim 8, wherein the determining of the reference grayscale value comprises:

storing the one or more frames of the image data;

extracting a maximum grayscale value from one of the stored frames of the image data; and determining the maximum grayscale value as the reference grayscale value.

11. The displaying method of claim 10, wherein a first level of the second pixel driving voltage and a second level of the analog driving voltage vary according to the reference grayscale voltage of individual frames.

12. The displaying method of claim 8, wherein, as the reference grayscale value decreases, the second pixel driving voltage increases, and the analog driving voltage decreases.

* * * * *